US007040049B2

(12) United States Patent
Cox et al.

(10) Patent No.: US 7,040,049 B2
(45) Date of Patent: May 9, 2006

(54) INTEGRATED ELECTRONIC GIFT CARD PACKET

(75) Inventors: Christopher Robert Cox, Orangeville (CA); William Dale Ritchie, Richmond (CA); Remi Lambert, Burlington (CA); William Garland, Mississanga (CA)

(73) Assignee: Relizon Canada Inc., Quebec (CA)

( * ) Notice: Subject to any disclaimer, the term of this patent is extended or adjusted under 35 U.S.C. 154(b) by 956 days.

(21) Appl. No.: 09/918,819

(22) Filed: Aug. 1, 2001

(65) Prior Publication Data

US 2003/0028439 A1 Feb. 6, 2003

(51) Int. Cl.
*G09F 1/00* (2006.01)

(52) U.S. Cl. ..... 40/124.191; 283/101; 283/106; 40/121.11

(58) Field of Classification Search ..... 283/75, 283/77, 78, 101, 105, 109, 106; 40/124.191, 40/124.11, 124.12
See application file for complete search history.

(56) References Cited

U.S. PATENT DOCUMENTS

| | | | | |
|---|---|---|---|---|
| 5,442,567 | A | 8/1995 | Small | |
| 5,660,896 | A | 8/1997 | Normand et al. | |
| 6,148,550 | A | 11/2000 | Niedfeld | |
| 6,315,206 | B1 * | 11/2001 | Hansen et al. | 235/487 |
| 6,318,757 | B1 * | 11/2001 | Ritchie et al. | 283/75 |
| 6,322,655 | B1 * | 11/2001 | Casagrande | 156/257 |
| 6,431,448 | B1 * | 8/2002 | Nelson et al. | 235/462.13 |
| 6,502,757 | B1 * | 1/2003 | Iwamoto et al. | 235/494 |
| 6,753,830 | B1 * | 6/2004 | Gelbman | 345/55 |

FOREIGN PATENT DOCUMENTS

WO WO 98 51513 A 11/1998

* cited by examiner

*Primary Examiner*—Andrew J. Fischer
(74) *Attorney, Agent, or Firm*—Jacobson Holman PLLC

(57) ABSTRACT

An integrated gift card packet is machine printed and formed and comprises a paper form having at least two panels interconnected together. The panels are retained in facial contact by detachable tabs or glue tabs. Each of the panels has an inner and an outer surface. Printed information is provided on some or all of the surfaces. Card information is printed in a card area on the inner and outer surfaces of one of the panels. The card information contains a bar code identifying goods/services and a dollar value associated therewith. The bar code may have a card I.D. code. A poly patch is adhesively secured on the inner surface of one of the panels and extends over the card area. A rear multi-layer patch is adhesively secured on the outer surface of one of the panels and also extends over the card area. The multi-layer patch has an adhesive coating on the outer surface to secure a poly film thereto. An adhesive release coating is provided on an outer surface of the poly film and a further dry release adhesive is provided over the adhesive release coating to secure an outer backing sheet thereto. A card is die-cut in the panel having the card information whereby the card can be removed from the panel and separated from the rear multi-layer patch with both the top and back surface of the card being laminated with a poly film. Several examples of the gift card packet are disclosed.

17 Claims, 5 Drawing Sheets

INTEGRATED ELECTRONIC GIFT CARD PACKET

TECHNICAL FIELD

The present invention relates to an integrated gift card packet which is machine printed on paper to provide a sealed packet having two or more juxtaposed panels and one or more removable integrally formed poly laminated cards in one of the panels and removable from inside the packet and wherein the card contains a bar code identifying goods/services to be purchased and a dollar value associated therewith.

BACKGROUND ART

It is known to fabricate plastic laminated cards in a paper form and such is described in co-pending application Ser. No. 09/684,130, filed Oct. 10, 2000, entitled "Integrated Dual-Laminate Identification Card in a Form and Method of Making the Card", assigned to Crain-Drummond Inc. Business forms with removable cards are now well known in the art and as described in the prior art these may be used as a mailer for mailing insurance cards, membership cards, telephone cards, etc. However, the use of these cards is primarily for identification. The cards are also mailed in a paper form with the form containing various instructions as to how to use and activate the card and instructions are often also printed on the back surface of the card itself before it is laminated by adhesive patches of poly film secured to the front and back of the printed card before the card is die-cut.

SUMMARY OF INVENTION

We have found a need to provide new uses for these cards as well as producing a form to carry these cards for such new uses.

It is therefore a feature of the present invention to provide an integrated gift card packet which comprises a paper form having at least two panels, with one of the panels carrying a detachable laminated card having on one surface of the card a bar code identifying a goods/services and a dollar value associated with the goods/services. The bar code may also have a card identifying member.

Another feature of the present invention is to also provide a further code to identify another feature of the card.

Another feature of the present invention is to provide an integrated gift card packet which is sold to an authorized person for a predetermined dollar value printed on the packet and wherein the packet comprises a printed activation code to register the user who has purchased the card as well as a goods/services and dollar value identification code, all storable in a computer memory, whereby future use of the card, when purchasing goods or services, automatically deducts a used dollar value from the computer stored I.D. dollar value.

A still further feature of the present invention is to provide a gift card packet wherein the bar code printed on the card is visible and scannable from the outer surface of one of the panels of the packet.

Another feature of the present invention is to provide an integrated gift card packet which is easy to use and which may be used in a display rack and which contains a detachable poly-laminated card which can only be used by an authorized person.

A still further feature of the present invention is to provide an integrated gift card packet which may be mailed to intended users and which can only be utilized by authorized users at a point of authorized use.

According to the above features, from a broad aspect, the present invention provides an integrated gift card packet comprising a paper form having at least two panels. The panels are retained in facial contact by detachable means. Each of the panels defines inner and outer surfaces. Printed information is provided on some or all of the surfaces. Card information is printed in a removable card area on the inner and outer surface of one of the panels. The card information contains a bar code identifying goods/services and a dollar value associated therewith. A single poly patch is adhesively secured over the card area on the inner surface of one of the panels. A multi-layer patch is secured over the card area on the outer surface of the said one of the panels. The multi-layer patch has an adhesive coating to secure a poly film on the outer surface of the card area of the said one of the panels. An adhesive release coating is provided on an outer surface of the poly film and a further dry release adhesive over the adhesive release coating to secure an outer backing sheet thereto. A card is die-cut in the removable card area from the inner surface of the said one of the panels to delineate a card containing the card information. The die-cut extends through the single poly patch and through the poly film of the muti-layer patch up to the adhesive release coating. The adhesive release coating provides a friction retention force to maintain the die-cut card in the one of the said panels and permits the card to be peeled off the one of the said panels from the inner surface thereof.

BRIEF DESCRIPTION OF DRAWINGS

A preferred embodiment of the present invention will now be described with reference to the examples thereof as illustrated in the accompanying drawings in which.

DESCRIPTION OF PREFERRED EMBODIMENTS

Figure 1:
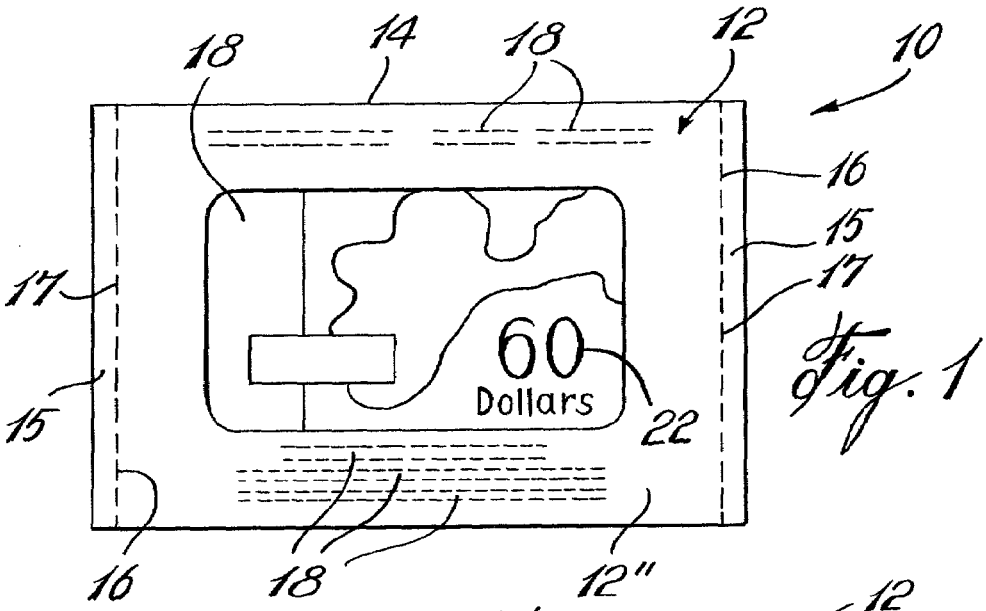
FIG. 1 is a plan view of the front face of one example of an integrated electronic gift card packet constructed in accordance with the present invention.
Figure 2:
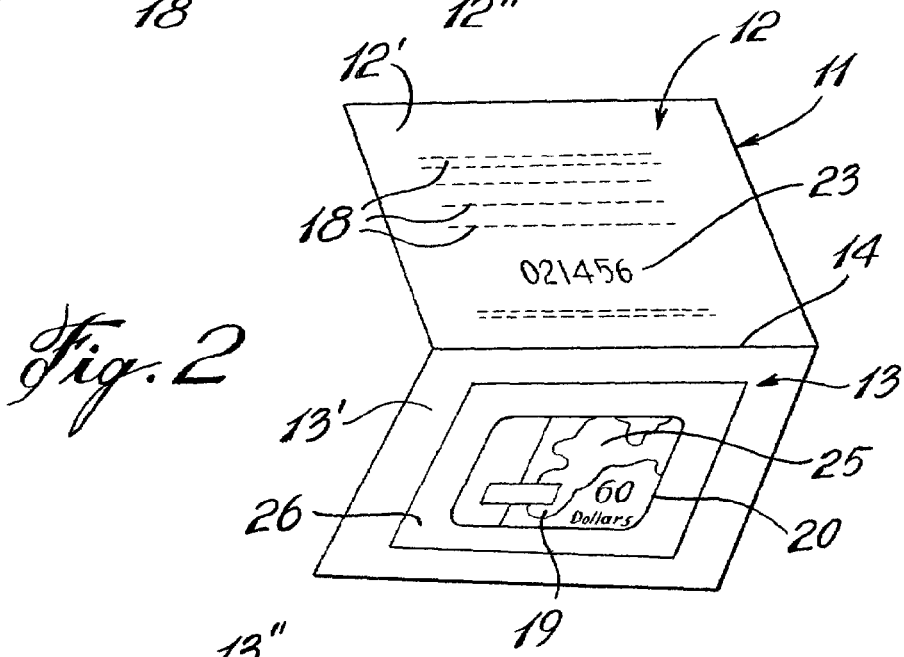
FIG. 2 is a perspective view showing the integrated gift card packet of the present invention after the pair of detachable strips have been removed to expose the detachable card formed in one of the panels.
Figure 3:
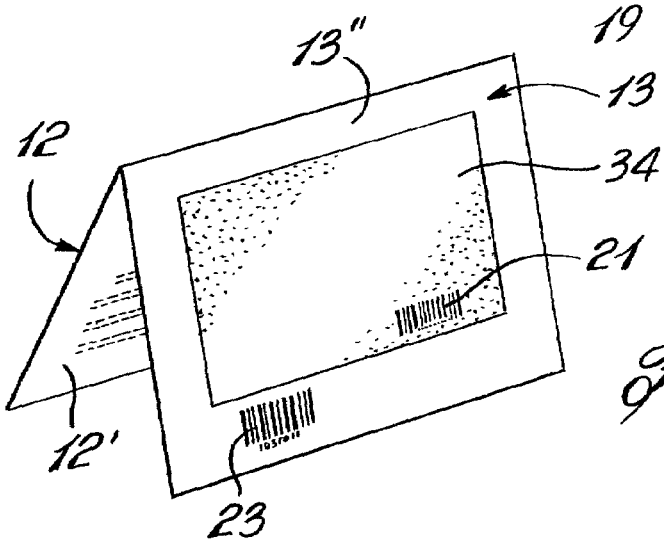
FIG. 3 is a perspective view showing the rear surface of the panel containing the integrated card.

Referring to the drawings, and more particularly to FIGS. 1 to 5, there is shown generally at 10 an example of an integrated gift card packet constructed in accordance with the present invention. The packet comprises a paper form 11 which defines at least two panels herein a top panel 12 and a rear panel 13. The panels are herein interconnected by a fold line 14. The panels are retained in folded facial contact, as shown in FIG. 1, by detachable means herein illustrated in the form of perforated tear strips 15 formed along opposed side edges 16 of the panels. The perforated tear line 17 forms the side edges of the panels. Other detachable means are contemplated as is obvious to a person skilled in the art. For example, an adhesive tab could be used on both sides of the packet. Also, the panels need not be interconnected by a fold line.

Each of the panels has inner and outer surfaces 12' and 12" and 13' and 13". Printed information 18 is provided on some or all of the surfaces of the panels. Card information 19 is printed in a card area 20 on the inner and outer surface of the rear panel 13. The card information contains a bar code 21 identifying goods/services and a dollar value associated therewith. The dollar value 22 is printed on the front face of the card, as shown in FIG. 1, for display purposes. The bar code 21 is on the rear surface 13" of the card. An I.D. code 23 may be printed on one of the panels and may be printed on the card 25. The I.D. code is herein shown as being constituted by a digital number code to identify an authorized user but may also be a bar code.

Figure 6:
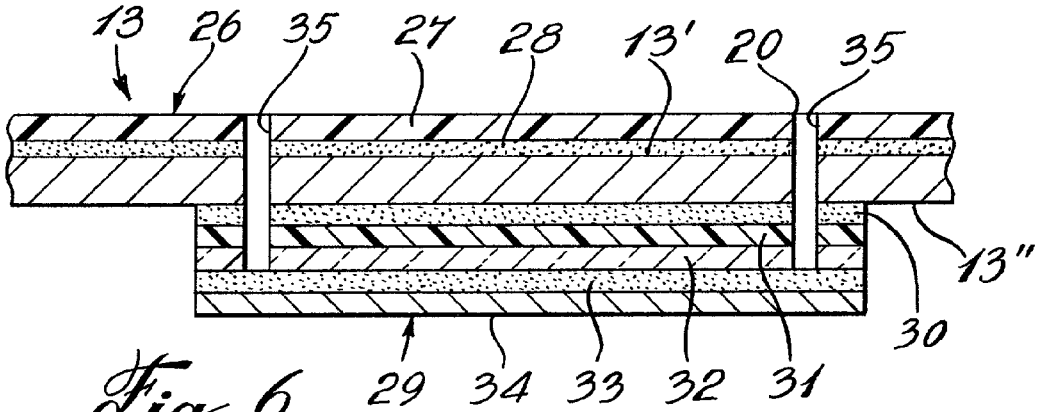
FIG. 6 is a section view, partly fragmented, showing the construction of the card on the panel with the front and rear patches adhesively secured thereto.

The card is formed in the rear panel 13 in a manner as will now be described with reference to FIG. 6. As hereinshown, a poly patch 26 which is comprised of a poly clear film 27 having an adhesive surface 28 is adhered to the inner surface 13' of the rear panel and extends over the card area 20. A rear multi-layer patch 29 is adhesively secured on the outer or rear surface 13" of the rear panel 13 and also extends over the card area 20. This multi-layer patch comprises a clear adhesive coating 30 provided on a surface of a poly film 31 and secured to the rear surface 13" of the rear panel. An adhesive release coating 32 is provided on an outer surface of the poly film and a further dry splitable adhesive 33 secures a back sheet 34 to the adhesive release coating. The back sheet 34 may be fabricated of any suitable material and it could have an opaque surface whereby the bar codes 21 and 23 on the rear surface 13" of the card cannot be seen through the rear surface of the form when the form is produced in accordance with FIGS. 1 to 3 wherein there are only two panels. However, the multi-layer patch 29 may also be transparent whereby the bar codes can be scanned through the rear panel without opening the packet.

Figure 4:
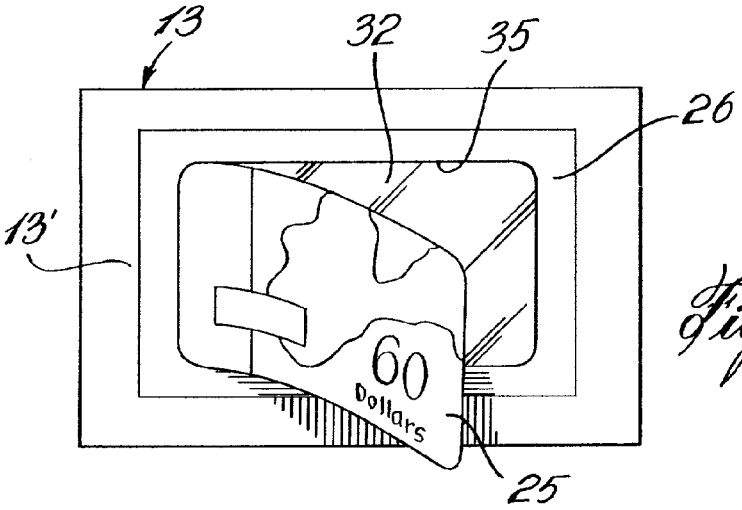
FIG. 4 is a plan view showing how the card is removed from the panel.
Figure 5:
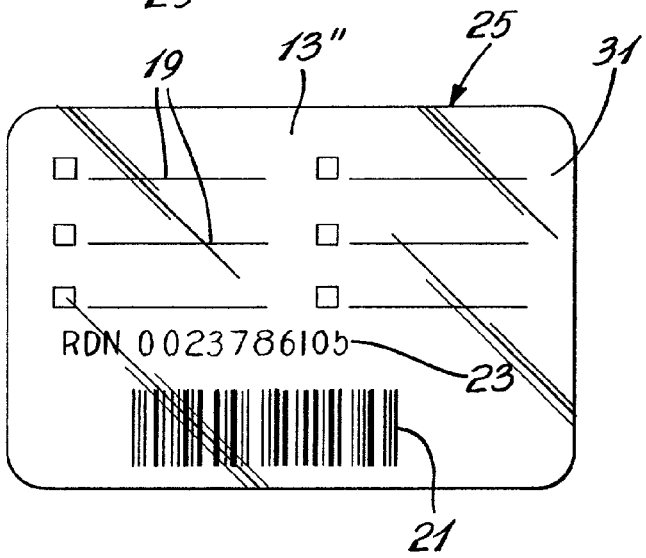
FIG. 5 is a rear view of the card after its removal from the panel.

A card die-cut 35 is formed in the rear panel in the card area 20 and extends through the front patch 26 and into the multi-layer rear patch up to and through the adhesive release coating 32. The adhesive release coating provides a friction retention force on the poly film to maintain the die-cut card 25 in the rear panel 13 and permits the card to be peeled off, as shown in FIG. 4, from the panel.

The printed information 18 contains advertising and instructional information such as information 19 printed on the back surface of the die-cut card to instruct the user as to how the card should be used.

Figure 7:
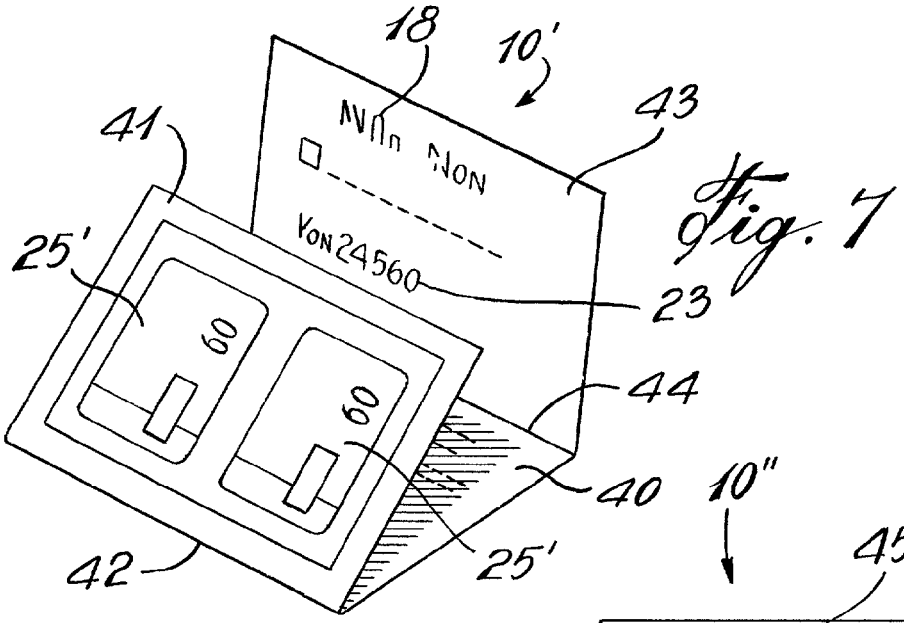
FIG. 7 is a perspective view of another example of an integrated gift card packet wherein the packet contains three panels folded together.

Referring now to FIG. 7, there is shown a further example of the integrated gift card packet 10' and as hereinshown the packet 10' is a paper form having three panels with the central panel 40 constituting a back panel and the card carrying panel 41 is folded thereon on fold line 42 with the top panel 43 being folded over the card carrying panel 41 on fold line 44. These three panels are again retained together by perforated transverse detachable strips, not shown, but constructed in accordance with FIG. 1. Accordingly, the card carrying panel 41 is concealed within the packet. The outer panels contain instructional information as well as advertising and card information. The bar codes of the card may also be printed on one of these outer panels, as above-described.

As also shown in FIG. 7, the packet may contain two identical die-cut cards 25' on the card carrying panel 41 for use by two authorized users or the same user with one card acting as a spare card.

Figure 8:
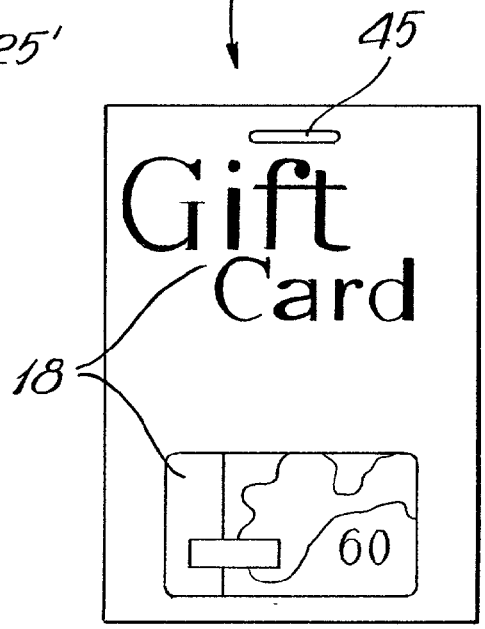
FIG. 8 is a plan view of a different integrated gift card packet constructed in accordance with the present invention and wherein the packet is provided with a wicker pin hole to retain and display the packet in a display rack.
Figure 9:
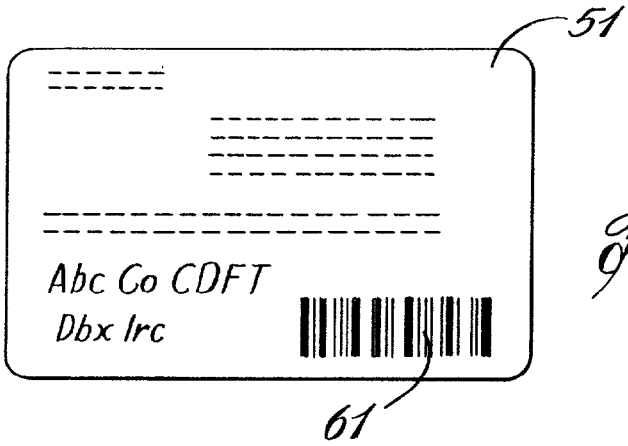
FIG. 9 is a plan view of the rear surface of the card formed in the integrated gift card packet of the present invention.

FIG. 8 shows another example of the integrated gift card packet of the present invention, and as hereinshown, the packet 10" has a wicker pin hole 45 formed in a top edge of the packet 10" whereby to support the packet in a display rack, not shown, but obvious to a person skilled in the art. These packets can also be stacked in display boxes and may be displayed, for example, at the cashiers of department stores, gas stations, etc., where the packets can be sold for the dollar redemption values indicated. The card is activated by passing the card or the packet in a bar code reader (not shown). Both the goods/services bar code 21 and the I.D. code 22, if provided, are entered into the computer memory. If the I.D. code is concealed in the packet, the packet is then opened whereby the personal I.D. code can be recorded to authorize the use of the card to purchase goods or services up to the recorded dollar value. The issuer of the card may permit access to different establishments associated with the issuer. If the packet and/or card contain only the good/services dollar value bar code 21, then when activating the card the user's name is entered into the computer program memory in association with the bar code 21. The bar code 21 may also include therein a card identification number to distinguish the card from other like cards, dependent on the use of the card.

Although we have described a use of the card contained in the packet at the point of purchase, these packets can also be mailed to intended users with each intended user having an I.D. code 23 which is contained in memory of the computer program associated with the card. To activate the card contained within the mailer packet, the recipient need only have the card scanned in a bar code reader. The bar code 21 may also be in the form of a magnetic strip. For example, if the card is used as a telephone calling card, the user would key in his I.D. pin number 23 as appearing on the card and pass the magnetic strip through a reader. As time is consumed during a telephone call, the dollar value in the computer is automatically deducted from the dollar value amount of the card. For example, if the dollar value 22 as appearing on the front panel of the card is sixty dollars ($60.00), the user can use up to sixty dollars worth of time. This time in dollar value is automatically calculated by the computer program. Once the used time reaches a predetermined value a message could automatically be transmitted to the user during a telephone call, advising that his total allocated time will expire in so many seconds or minutes.

In the case of purchasing goods, the total value of the goods are automatically deducted from the stored amount registered in the computer as the cashier punches in the goods being purchased. A message would be relayed to the computer of the cashier and be displayed on a screen either simultaneously as the goods are purchased to show the residual amount and if the total amount is exceeded then the excess amount would be paid in cash by the user or with another card. If there is a balance in the total amount, then that will remain in the computer memory and indicated on a sales receipt. The next time the user purchases goods at an authorized location, the residual amount would be made available for use on the next purchase. Of course, a user may have several of these cards.

Further examples of the construction of these packets 10 will now be described with reference to FIGS. 9 to 14. With some of the examples shown in FIGS. 1 to 8, it is described that the goods/services dollar value bar code 21 is printed both on the back face of the card and as well as on one of the panels, usually the outer face of the rear panel. In order to eliminate the risk of duplication of the bar code on another packet, when the high-speed printing machine is being stopped and started again, it is preferable that the bar code only appear on the card, as shown in FIGS. 10 to 14.

Figure 10:
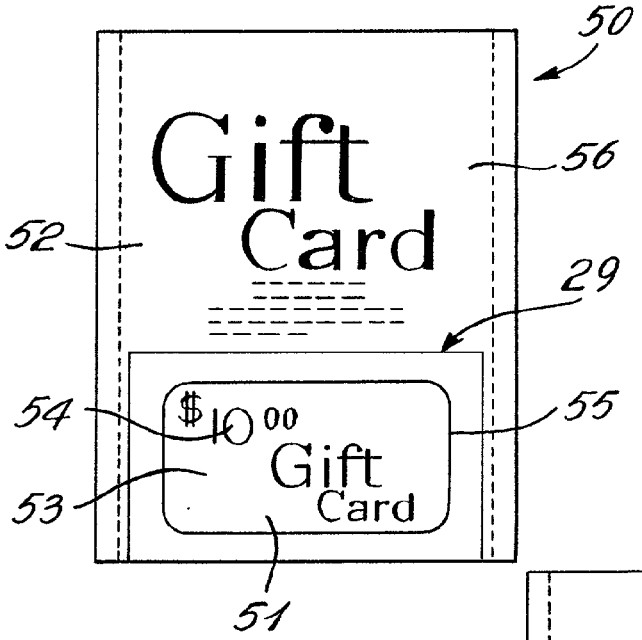
FIG. 10 is a plan view illustrating another example of the integrated gift card packet of the present invention and wherein the card is formed in the front panel of the packet.
Figure 11:
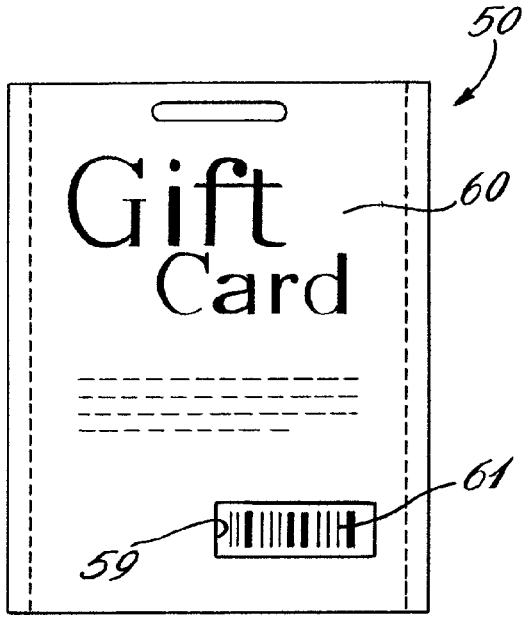
FIG. 11 is a plan view of the outer face of the rear panel associated with the packet of FIG. 10 showing a window which is cut in the back panel to expose the bar code on the rear surface of the card formed in the front panel.
Figure 12:
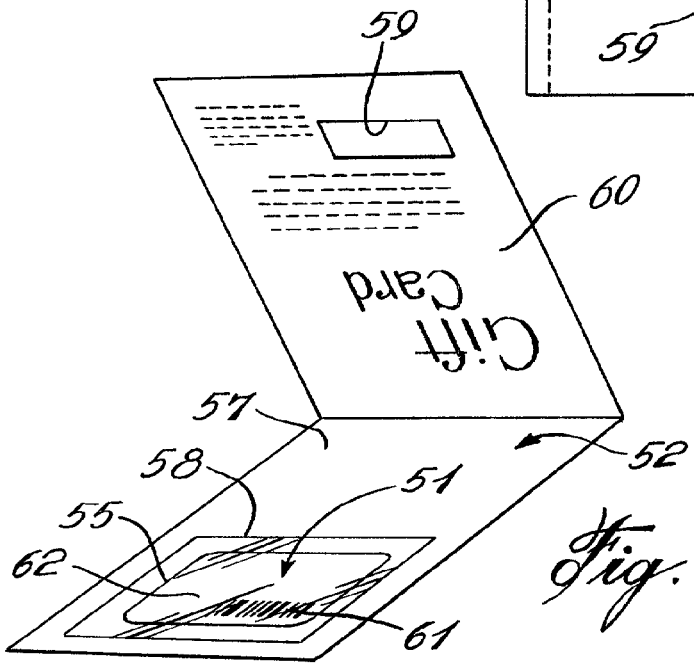
FIG. 12 is a perspective view showing the gift card packet of FIG. 10 in its open condition with the tear tabs having been removed.

FIGS. 10, 11 and 12 show the construction of a packet 50 and wherein the card 51 is printed on the front panel 52. The front face 53 of the card contains printed information 54 identifying the value of the gift card. The multi-layer patch 29, as shown in FIG. 6, is a clear patch disposed over the card area 55 on the outer surface 56 of the front panel 52. Accordingly, the card 51 is peeled off from the inner surface 57 of the front panel 52, as shown in FIG. 12. A single poly patch 58 is applied over the card area 55 on the inner surface 57 of the front panel 52. As shown in FIGS. 11 and 12, a window 59 is cut in the rear panel 60 and disposed in alignment with the goods/services dollar value bar code 61 printed on the rear surface 62 of the card 51. Accordingly, when the packet is in its sealed condition, as shown in FIG. 11, the bar code 61 is clearly visible and scannable through the window 59 in the rear panel 60 of the packet 50.

Figure 13:
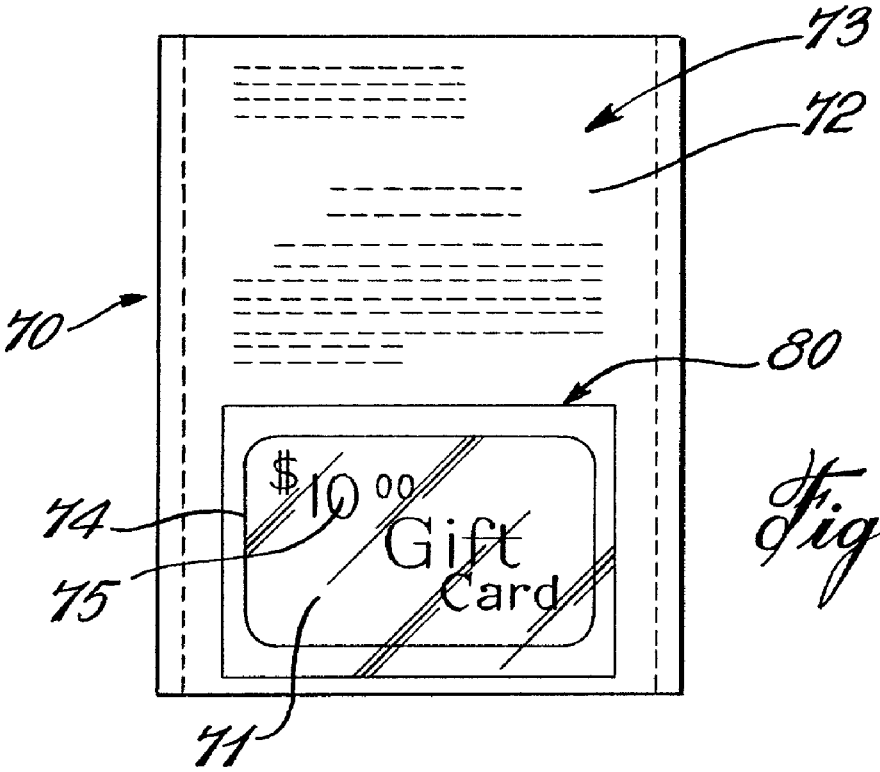
FIG. 13 is a plan view of the inner face of a rear panel wherein the card is formed integral with that panel and with the front face of the card being formed on the inner surface of the rear panel and the back face formed with the outer surface of the rear panel.
Figure 14:
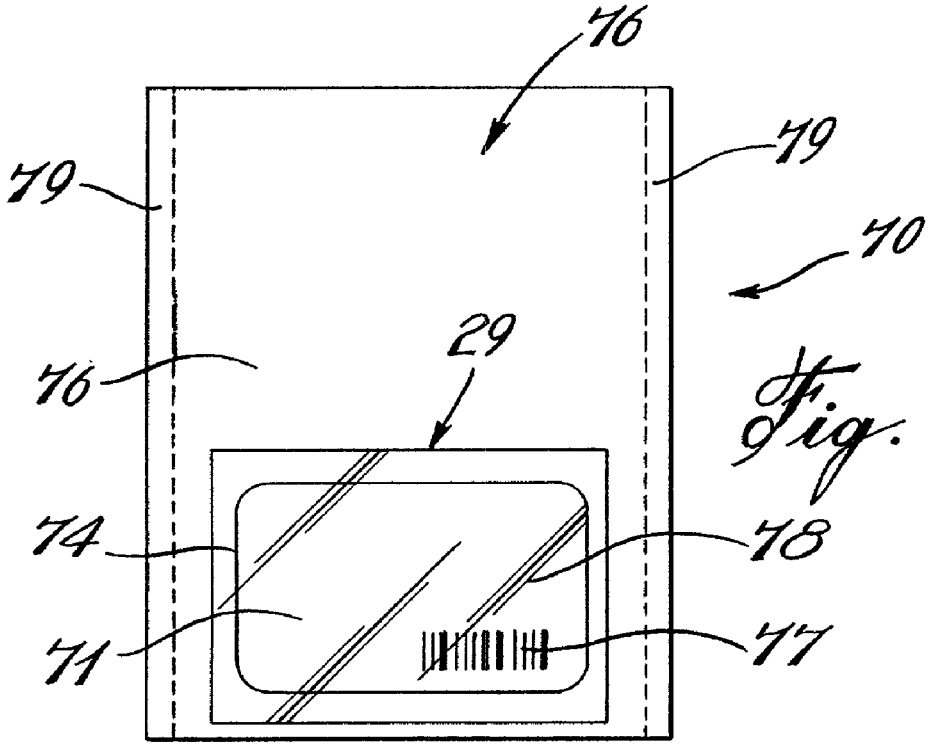
FIG. 14 is a plan view illustrating the outer surface of the rear panel of FIG. 13 and wherein the card rear surface is visible through a clear poly patch adhered to the outer face of the rear panel.

FIGS. 13 and 14 show a still further example of the integrated electronic gift card packet and as hereinshown the packet 70 has the card 71 printed in die-cut on the inner surface 72 of the back panel 73. A single poly film patch 80 is adhesively secured over the card area 74 and exposes the printed information 75 on the outer surface of the card 71. Accordingly, the card 71 is peeled from the inner surface of the back panel 73.

The rear panel 76 is illustrated in FIG. 14 and as hereinshown the multi-layer patch 79 is secured to the outer surface 76 of the rear panel over the card area 74. The multi-layer patch is a clear patch whereby to expose the goods/services dollar value bar code 77 printed on the rear surface 78 of the card 71. Accordingly, the packet 70 can be scanned without removing the tear strips 79 to detach the panels whereby to remove the card 71.

It is within the ambit of the present invention to cover any obvious modifications of the preferred embodiment described herein, provided such modifications fall within the scope of the appended claims.

We claim:

1. An integrated gift card packet comprising a paper form having at least two panels, said panels being retained in facial contact by detachable means and each said panels defining inner and outer surfaces, printed information on some or all of said surfaces, card information printed in a removable card area on said inner and outer surface of one of said panels, said card information containing a bar code identifying goods/services and a dollar value associated therewith, a single poly patch adhesively secured over said card area on said inner surface of one of said panels; a multi-layer patch secured over said card area on said outer surface of said one of said panels, said multi-layer patch having an adhesive coating to secure a poly film on said outer surface of said card area of said one of said panels, an adhesive release coating on an outer surface of said poly film and a further dry release adhesive over said adhesive release coating to secure an outer backing sheet thereto, a card die-cut in said removable card area from said inner surface of said one of said panels to delineate a card containing said card information, said die-cut extending through said single poly patch and through said poly film of said multi-layer patch up to said adhesive release coating, said adhesive release coating providing a friction retention force to maintain said die-cut card in said one of said panels and permitting said card to be peeled off said one of said panels from said inner surface thereof.

2. An integrated gift card packet as claimed in claim 1 wherein said goods/services dollar value bar code also includes therein a card identification number to identify said card and associate it with user identification information recorded at a designated point of use.

3. An integrated gift card packet as claimed in claim 1 wherein said at least two panels are interconnected by a fold crease line.

4. An integrated gift card packet as claimed in claim 2 wherein said card information contains a dollar value printed on a front face thereof and said goods/services dollar value bar code being printed on a rear surface of said card.

5. An integrated gift card packet as claimed in claim 2 wherein said one of said panels containing said card information is a front panel, the other of said panels being a rear panel having a window area aligned with said goods/services dollar value bar code on said card rear surface to expose same through said window area.

6. An integrated gift card packet as claimed in claim 5 wherein said multi-layer patch is secured over said card area on said outer surface of said front panel, said multi-layer patch being a clear patch to expose said printed card information on said outer surface of said front panel through said clear patch.

7. An integrated gift card packet as claimed in claim 2 wherein said one of said panels containing said card information is a rear panel, said multi-layer patch being secured over said card area on said outer surface of said rear panel, said multi-layer patch being a clear patch to expose said goods/services bar code on said outer surface of said rear panel.

8. An integrated gift card packet as claimed in claim 1 wherein said detachable means is constituted by perforated tear strips formed along opposed side edges of said panels.

9. An integrated gift card packet as claimed in claim 1 wherein said printed information contains advertising and instructional information, there being instructional information on said outer surface of said die-cut card.

10. An integrated gift card packet as claimed in claim 1 wherein said die-cut card also contains a user identification number code.

11. An integrated gift card packet as claimed in claim 1 wherein said paper form has three of said panels, a third of said panels being a central panel, said one of said panels being a first outer panel folded on said central panel in facial contact with an inner surface of said central panel, the other outer panel having its said inner surface folded over said first outer panel, said card area being disposed on opposed surfaces of said first outer panel concealed in said packet between said central panel and said other outer panel.

12. An integrated gift card packet as claimed in claim 1 wherein said one of said panels contains two or more of said die-cut cards.

13. An integrated gift card packet as claimed in claim 1 wherein said packet is further provided with a wicker pin hole adjacent a top edge thereof for support on a display rack.

14. An integrated gift card packet as claimed in claim 1 wherein said outer backing sheet of said multi-layer patch is an opaque sheet to conceal said printed information on said rear surface of said die-cut card.

15. An integrated gift card packet as claimed in claim 1 wherein there is further provided an identification code associated with said good/services dollar value bar code to identify said card.

16. An integrated gift card packet as claimed in claim 1 in combination with a computer program of a computer having a memory, said goods/services dollar value bar code being stored in said memory with user I.D. information to activate said card, said program performing a mathematical function to track dollar purchase amounts recorded in said memory and providing residual dollar value amounts.

17. An integrated gift card form comprising a paper form delineating one or more panels, said panels being integrally formed and each said panels defining inner and outer surfaces, printed information on some or all of said surfaces, card information printed in a removable card area on said inner and outer surface of one of said panels, said card information containing a bar code identifying goods/services and a dollar value associated therewith, a single poly patch adhesively secured over said card area on said inner surface of one of said panels; a multi-layer patch secured over said card area on said outer surface of said one of said panels, said multi-layer patch having an adhesive coating to secure a poly film on said outer surface of said card area of said one of said panels, an adhesive release coating on an outer surface of said poly film and a further dry release adhesive over said adhesive release coating to secure an outer backing sheet thereto, a card die-cut in said removable card area from said inner surface of said one of said panels to delineate a card containing said card information, said die-cut extending through said single poly patch and through said poly film of said multilayer patch up to said adhesive release coating, said adhesive release coating providing a friction retention force to maintain said die-cut card in said one of said panels and permitting said card to be peeled off said one of said panels from said inner surface thereof.

* * * * *